US009409199B2

(12) United States Patent
Nakano

(10) Patent No.: US 9,409,199 B2
(45) Date of Patent: Aug. 9, 2016

(54) FLUID DISCHARGING DEVICE

(75) Inventor: Takumi Nakano, Kagawa (JP)

(73) Assignee: UNICHARM CORPORATION, Ehime (JP)

( * ) Notice: Subject to any disclaimer, the term of this patent is extended or adjusted under 35 U.S.C. 154(b) by 901 days.

(21) Appl. No.: 13/520,195

(22) PCT Filed: Dec. 3, 2010

(86) PCT No.: PCT/JP2010/071636

§ 371 (c)(1),
(2), (4) Date: Oct. 10, 2012

(87) PCT Pub. No.: WO2011/083644

PCT Pub. Date: Jul. 14, 2011

(65) Prior Publication Data

US 2013/0019798 A1 Jan. 24, 2013

(30) Foreign Application Priority Data

Jan. 8, 2010 (JP) ..... 2010-003122

(51) Int. Cl.

| | |
|---|---|
| ***B05C 5/00*** | (2006.01) |
| ***B05C 5/02*** | (2006.01) |
| ***B05B 12/08*** | (2006.01) |
| *B05B 13/04* | (2006.01) |

(52) U.S. Cl.

CPC ..... *B05C 5/0279* (2013.01); *B05B 12/084* (2013.01); *B05B 13/041* (2013.01)

(58) Field of Classification Search

None

See application file for complete search history.

(56) References Cited

U.S. PATENT DOCUMENTS

| | | | | |
|---|---|---|---|---|
| 2003/0098317 | A1 | 5/2003 | McGuffey | |
| 2005/0241576 | A1 * | 11/2005 | Gaon et al. | 118/665 |
| 2006/0108513 | A1 | 5/2006 | Valentin et al. | |
| 2011/0311716 | A1 * | 12/2011 | Taylor et al. | 427/8 |

FOREIGN PATENT DOCUMENTS

| | | | |
|---|---|---|---|
| EP | 1591170 | A2 | 11/2005 |
| JP | 58156369 | A | 9/1983 |
| JP | 5111658 | A | 5/1993 |

(Continued)

OTHER PUBLICATIONS

Office Action mailed Sep. 3, 2013 corresponds to Japanese patent application No. 2010-003122.

(Continued)

*Primary Examiner* — Dah-Wei D Yuan
*Assistant Examiner* — Jethro M Pence
(74) *Attorney, Agent, or Firm* — Hauptman Ham, LLP

(57) ABSTRACT

A fluid discharging device that discharges fluid from a plurality of discharge openings towards a continuous sheet member which is continuously transported in a transporting direction. The fluid discharging device includes: a plurality of valves that correspond to the discharge openings and intermittently discharge the fluid from the discharge openings by opening and closing operations; and a controller that controls the opening and closing operations of each of the valves individually depending on a transportation amount of the continuous sheet member. The controller has a shared adjustment value that is represented by a value indicating the transportation amount, the controller shifts open-close timing of at least several valves of the a plurality of valves from a previously-determined open-close timing that the several valves are subject to, based on the shared adjustment value.

8 Claims, 7 Drawing Sheets

(56) References Cited

FOREIGN PATENT DOCUMENTS

| | | | |
|---|---|---|---|
| JP | 6198239 | A | 7/1994 |
| JP | 6237957 | A | 8/1994 |
| JP | 7228036 | A | 8/1995 |
| JP | 10504266 | A | 4/1998 |
| JP | 2003211059 | A | 7/2003 |
| JP | 2005-313171 | A | 11/2005 |
| WO | 9604874 | A1 | 2/1996 |

OTHER PUBLICATIONS

Extended European Search Report dated Jul. 30, 2014, corresponds to European patent application No. 10842159.5.

Office Action dated Dec. 6, 2013, corresponds to Chinese patent application No. 201080060770.5.

International Search Report for PCT/JP2010/071636, dated Mar. 1, 2011.

* cited by examiner

FLUID DISCHARGING DEVICE

RELATED APPLICATIONS

The present application is a National Phase of International Application Number PCT/JP2010/071636, filed Dec. 3, 2010, and claims priority from Japanese Application Number 2010-003122, filed Jan. 8, 2010.

TECHNICAL FIELD

The invention relates to a fluid discharging device which is used for manufacturing an absorbent article associated with a disposable diaper and the like, the fluid discharging device discharging fluid such as hot-melt adhesive towards a continuous sheet member made of nonwoven fabric and the like.

BACKGROUND ART

Conventionally, in a manufacturing line of disposable diapers and the like, while continuously conveying in a transporting direction a continuous sheet member such as nonwoven fabric and the like, hot-melt adhesive is intermittently applied to the continuous sheet member by discharging the adhesive in the transporting direction ([PTL 1]).

CITATION LIST

Patent Literature

[PTL 1] Japanese Patent Application Laid-open Publication No. 6-237957

SUMMARY OF THE INVENTION

Technical Problem

This intermittent application is performed by a hot-melt adhesive applying device 10 (hereinafter referred to as HMA applying device 10) (FIGS. 1A and 1B). The HMA applying device 10 includes a head 11 which is, for example, arranged at a certain position in the transporting direction, and the head includes a plurality of nozzles N, N . . . lined up in the width direction of a continuous sheet member 2. Corresponding to each of the nozzles N, one valve 14 (not shown in FIGS. 1A and 1B) is disposed. The valves 14 open and close under control of the controller 30 depending on an amount of transportation of the continuous sheet member 2, and thereby the nozzles N intermittently discharges hot-melt adhesive towards the continuous sheet member 2.

In order to control opening and closing operations of the valves 14 depending on transportation amount, an encoder 80 is used, for example. The encoder 80 is configured, for example, so as to repeatedly output a digital value from 0 to 8191 during a period in which the continuous sheet member 2 is transported by an amount corresponding to a product pitch P (the length P of one product) of the diaper, the digital value being proportional to the amount by which the continuous sheet member 2 is transported; the product pitch P being defined on the continuous sheet member 2. The controller 30 controls opening and closing operations of the valves 14 as follows: open the valves 14 when a digital value transmitted from the encoder 80 reaches the predetermined first regulation value; close the valves 14 when the digital value reaches the predetermined second regulation value; and the like. The first regulation value, the second regulation value, etc are set up respectively for the valves 14.

By the way, a periodic repair work of the manufacturing line or a product change (including changing the size of the product) of a product (diaper) may change the relationship in the transporting direction between the position of the head 11 of the HMA applying device 10 and the position of the encoder 80. In this case, after the repair work or product change, the actual applying position of hot-melt adhesive may be displaced in the transporting direction from its target position if the hot-melt adhesive is discharged based on the regulation values from before the periodic repair work or product change.

Therefore, when preparing the manufacturing line after the periodic repair work or the product change, an operator of the manufacturing line resets the foregoing regulation values. More specifically, the procedure is as follows. Firstly, while maintaining the foregoing regulation values from before the periodic repair work or product change, hot-melt adhesive is discharged from the head 11 towards the continuous sheet member 2 which is being conveyed at a certain velocity. Then, operator measures the displacement of the actual applying position from the target position of the adhesive on the continuous sheet member 2. Such values as the foregoing first and second regulation values are then shifted by the amount corresponding to the measured displacement and these shifted values are input to the first and second regulation values. Thereby, the open-close timing of the valves 14 is adjusted.

However, all the valves 14, 14, . . . require to be adjusted as mentioned above. This forces the operator to take considerable time and effort.

The invention has been made in view of the above conventional problems, and an advantage thereof is to provided a fluid discharging device which can reduce considerable time and effort to adjust the open-close timing of the valves.

Solution to Problem

An aspect of the invention to achieve the above advantage is

A fluid discharging device that discharges fluid from a plurality of discharge openings towards a continuous sheet member which is continuously transported in a transporting direction, the discharge openings being arranged in a width direction of the continuous sheet member associated with an absorbent article, comprising:

a plurality of valves that correspond to the discharge openings and intermittently discharge the fluid from the discharge openings by opening and closing operations; and a controller that controls the opening and closing operations of each of the valves individually depending on a transportation amount of the continuous sheet member, wherein the controller has a shared adjustment value that is represented by a value indicating the transportation amount, and the controller shifts an open-close timing of at least several valves of the plurality of valves from a previously-determined open-close timing of the several valves, based on the shared adjustment value.

Other features of this invention will become apparent from the description in this specification and the attached drawings.

Effects of the Invention

According to the invention, it is possible to reduce considerable time and effort to adjust the open-close timing of the valves.

MODE FOR CARRYING OUT THE INVENTION

Figure 1A:
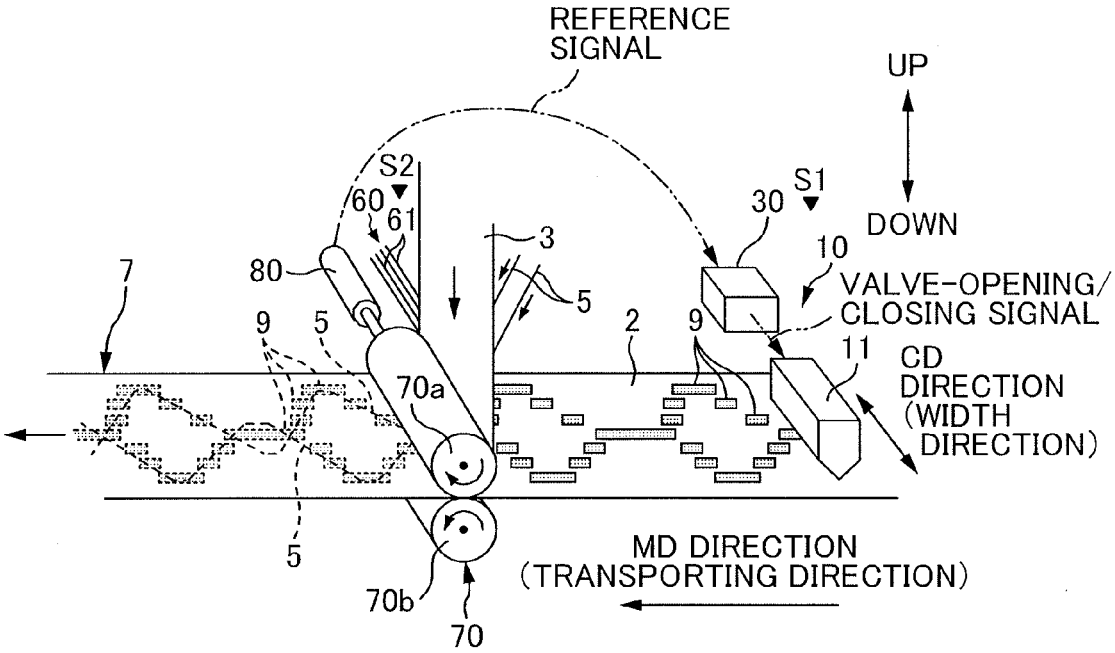
FIG. 1A is a schematic perspective view of a manufacturing line including an HMA applying device 10 according to the first embodiment.

At least the following matters will be made clear by the description in the present specification and the accompanying drawings.

A fluid discharging device that discharges fluid from a plurality of discharge openings towards a continuous sheet member which is continuously transported in a transporting direction, the discharge openings being arranged in a width direction of the continuous sheet member associated with an absorbent article, comprising:

a plurality of valves that correspond to the discharge openings and intermittently discharge the fluid from the discharge openings by opening and closing operations; and a controller that controls the opening and closing operations of each of the valves individually depending on a transportation amount of the continuous sheet member, wherein the controller has a shared adjustment value that is represented by a value indicating the transportation amount, and the controller shifts an open-close timing of at least several valves of the plurality of valves from a previously-determined open-close timing of the several valves, based on the shared adjustment value.

With such a fluid discharging device, the controller can control the several valves so that the several valves open and close at the timing which is shifted by at least the amount corresponding to the shared adjustment value from the previously-determined open-close timing of the several valves. That is, the open-close timing can be shifted by the amount corresponding to the shared adjustment value at the same time for the several valves. Therefore, it is not necessary to adjust each of the valves individually. This makes it possible to considerably reduce work loads for adjusting the open-close timing of the valves.

In such a fluid discharging device, it is desirable that the controller calculates a shared compensation value of the opening and closing operations of the several valves based on a transport velocity of the continuous sheet member the controller shifts the open-close timing of the several valves from the previously-determined open-close timing based on the shared adjustment value and the shared compensation value.

With such a fluid discharging device, when compensating the open-close timing of the valves according to the change of the transport velocity, the shared compensation value is used for the several valves. This makes it possible to reduce an operational load of the controller.

Further, the shared compensation value is used for the several valves. Therefore, the compensation data, such as a compensation-value table, used when obtaining the compensation value does not have to be prepared for each valve. This makes it possible to reduce considerable time and effort to prepare the compensation data.

In such a fluid discharging device, it is desirable that in the case where the several valves are defined as a first valve group, discharge openings corresponding to the valves that belong to the first valve group are defined as a first discharge opening group, and the shared adjustment value is defined as a first shared adjustment value, the fluid discharging device further comprises a second discharge opening group that are located on a downstream side of the first discharge opening group in the transporting direction, and the controller shifts an open-close timing of another plurality of valves from a previously-determined open-close timing of the other plurality of valves, based on a second shared adjustment value, the valves corresponding to discharge openings that belong to the second discharge opening group.

With such a fluid discharging device, the controller can control the other plurality of valves corresponding to the discharge openings that belong to the second discharge opening group so that the other plurality of valves open and close at the timing which is shifted by at least the amount corresponding to the second shared adjustment value from the previously-determined open-close timing of the other plurality of valves. This makes it possible to adjust the open-close timing of the first valve group and the open-close timing of the second valve group independently, resulting in excellent convenience.

In such a fluid discharging device, it is desirable that the controller has a third shared adjustment value, and the controller shifts opening/closing timing of a valve that belongs to the first valve group and the second valve group based on the third shared adjustment value, independently of the first shared adjustment value and the second shared adjustment value.

With such a fluid discharging device, the open-close timing can be shifted by the amount corresponding to the third shared adjustment value at the same time for both the first valve group and the second valve group, resulting in excellent convenience.

In such a fluid discharging device, it is desirable that in the case where the several valves are defined as a first valve group, discharge openings corresponding to the valves that belong to the first valve group are defined as a first discharge opening group, and the shared adjustment value is defined as a first shared adjustment value, the fluid is supplied to each valve of the first valve group through a shared first supply path, in the case where a second supply path is included in addition to the first supply path, a plurality of valves to which the fluid is supplied through the second supply path is defined as a second valve group, and discharge openings corresponding to the valves that belong to the second valve group are defined as a second discharge opening group, the controller shifts open-close timing of the valves that belong to the second valve group from a previously-determined open-close timing that the valves are subject to, based on a second shared adjustment value.

With such a fluid discharging device, the open-close timing of each of the supply paths can be adjusted individually. Therefore, the timing can be precisely adjusted, which results in increase of accuracy of the fluid positions in landing on the continuous sheet member. The more detailed description is as follows. In case of the discharge opening groups whose supply paths are different from each other, it is possible that the fluid which flows through each of the paths is different in properties such as viscosity from each other. In this case, the discharge opening groups are different in discharge characteristics of the fluid from each other. As a result, if only one shared adjustment value is used, it is difficult for the fluids which are discharged from different discharge opening groups having their own supply paths to all land on their own predetermined target positions on the continuous sheet member.

On this point, with the foregoing configuration, the shared adjustment value can be set up for each of the supply paths respectively. Therefore, as for the discharge opening groups whose supply paths are different from each other, the landing positions can be adjusted independently. This can increase the accuracy of the fluid positions in landing on the continuous sheet member for both of the discharge opening groups.

In such a fluid discharging device, it is desirable that the previously-determined open-close timing includes a previously-determined opening timing and a previously-determined closing timing, the controller includes, for each of the valves, a first regulation value that sets up the previously-determined opening timing and a second regulation value that sets up the previously-determined closing timing, the first regulation value and the second regulation value are represented by the value indicating the transportation amount, and using the value indicating the transportation amount, the controller controls the opening and closing operations of each of the valves individually depending on the transportation amount.

With such a fluid discharging device, the previously-determined open-close timing can be set up for each of the valves. Therefore, by combining landing marks of fluid discharged towards the continuous sheet member from the discharge openings which respectively correspond to the several valves, any landing pattern of the fluid can be formed on the continuous sheet member.

Further, shifting the open-close timing of the several valves from the previously-determined open-close timing based on the shared adjustment value makes it possible to form the landing pattern which is displaced in the transporting direction of the continuous sheet member while substantially maintaining the shape of the landing pattern without deformation.

First Embodiment

Figure 1B:
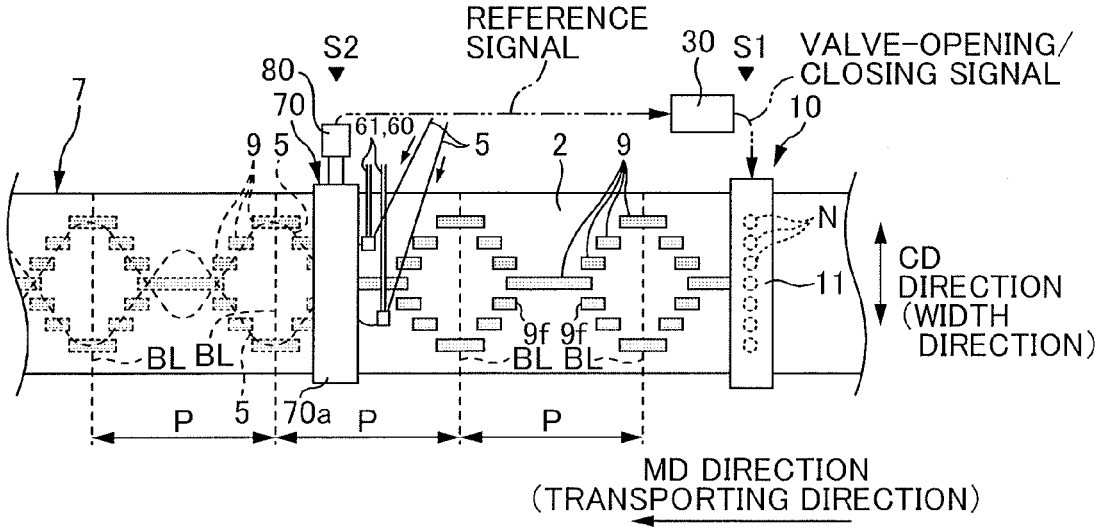
FIG. 1B is a plan view of the same.

FIG. 1A is a schematic perspective view of a manufacturing line including a fluid discharging device 10 according to the first embodiment, and FIG. 1B is a plan view of the same.

On this manufacturing line, a continuous body 7, which is a half-completed product, is produced. For example, the continuous body 7 includes: a continuous sheet member 2 which serves as a top sheet of a diaper and is made of nonwoven fabric, etc; a continuous sheet member 3 which serves as a back sheet of the diaper and is made of nonwoven fabric, etc; and a pair of rubber threads 5 and 5 which are placed between these sheet members to form leg gathers.

That is, this manufacturing line includes a transporting apparatus (not shown) such as a roll, etc. which continuously conveys the continuous sheet member 2 in a transporting direction, which is the MD direction. On the conveying path, there are the two following sections: an HMA application section S1 in which hot-melt adhesive (hereinafter also referred to as HMA) is applied to the continuous sheet member 2 in such an application pattern as a pair of approximate sine curves; and a processing section S2 in which while the rubber threads 5 and 5 being continuously supplied towards an HMA applying area 9 on the continuous sheet member 2, the continuous sheet member 3 which becomes a back sheet is placed on and bonded to the continuous sheet member 2.

Hereinafter, a direction perpendicular to the MD direction is referred to as a CD direction; the CD direction is the same as the width direction of the continuous sheet members 2 and 3.

In the HMA application section S1, an HMA applying device 10 is installed. The HMA applying device 10 corresponds to "fluid discharging device" according to the invention, which will be described later.

In the processing section S2, there are installed a rubber-thread supply device 60 and pressing rolls 70 which are examples of a processing apparatus. The rubber-thread supply device 60 includes a pair of arms 61 and 61 which moves back and forth in the CD direction while supplying the rubber threads 5 and 5 in the MD direction. While moving back and forth once during a period in which the continuous sheet member 2 is transported by an amount corresponding to a product pitch P in the MD direction, the arms 61 and 61 supply the rubber threads 5 and 5 towards the nip of the pressing rolls 70. Thereby, the arms 61 and 61 place the rubber threads 5 and 5 on the continuous sheet member 2 in an arrangement pattern such as an approximate sine curve which is similar to the foregoing application pattern.

The pressing rolls 70 have a pair of upper and lower rolls 70*a* and 70*b* which are driven and rotate about an rotational axis pointing in the CD direction. To the nip of them, there are fed not only the foregoing continuous sheet member 2 but also the continuous sheet member 3 which becomes a back sheet. Therefore, the continuous sheet member 2 which becomes a top sheet and the continuous sheet member 3 which becomes a back sheet overlay each other having the rubber threads 5 and 5 between these two sheets 2 and 3; the threads and the sheets are pinched by the pair of rolls 70*a* and 70*b* and are crimped.

On the continuous sheet member 2 which becomes a top sheet, a layout of a plurality of diapers lined up in the MD direction at the product pitch P is planned. In other words, target positions where such various parts as the rubber threads 5 and 5 will be joined or processed are planned. In the first embodiment, identification of which of the target positions in a diaper corresponds to the portion that is currently being processed by a processing apparatus is performed with reference to the pressing rolls 70. That is, it is possible to detect in real time which portion of the diaper is currently passing the pressing rolls 70 and which portion is being crimped thereby.

The detection is performed, for example, by a rotary encoder 80 which is disposed of the shaft end of one of the pressing rolls 70 in an integrated manner. Specifically, the encoder 80 outputs one of, for example, 8192 digital values (corresponding to the "value indicating the transportation amount") from 0 to 8191, during a period in which the continuous sheet member 2 is transported by an amount corresponding to the product pitch P, the digital value being proportional to the amount by which the sheet member 2 is transported; and the encoder 80 repeats it. In addition thereto, "0" of the digital values is defined to be associated with the boundary position BL of products adjacent in the MD direction. That is, when the boundary position BL passes through the nip of the pressing rolls 70, the encoder 80 outputs a digital value "0", and then outputs digital values successively from "1" to "8191" till the next boundary position BL passes.

These digital values are used, for example, as a reference signal for controlling the back-and-forth motion of the arms 61 and 61 of the rubber-thread supply device 60. That is, the rubber-thread supply device 60 includes: a servomotor (not shown) which moves the arms 61 and 61 back and forth in the CD direction; and a controller (not shown). The controller drives and controls the servomotor based on the digital values that are input from the encoder 80, and thereby the arms 61 and 61 move back and forth in the CD direction. More specifically, the controller recognizes which portion of the diaper is currently passing the nip of the pressing rolls 70, based on the digital value of the encoder 80; simultaneously, the controller causes the rubber threads 5 and 5 to move to and be arranged at the position where in the CD direction the rubber threads 5 are to be joined. Thereby, the rubber threads 5 and 5 are arranged at a position where in the individual product the rubber threads are to be processed. Hereinafter, the digital value is also referred to as a reference signal.

Figure 2:
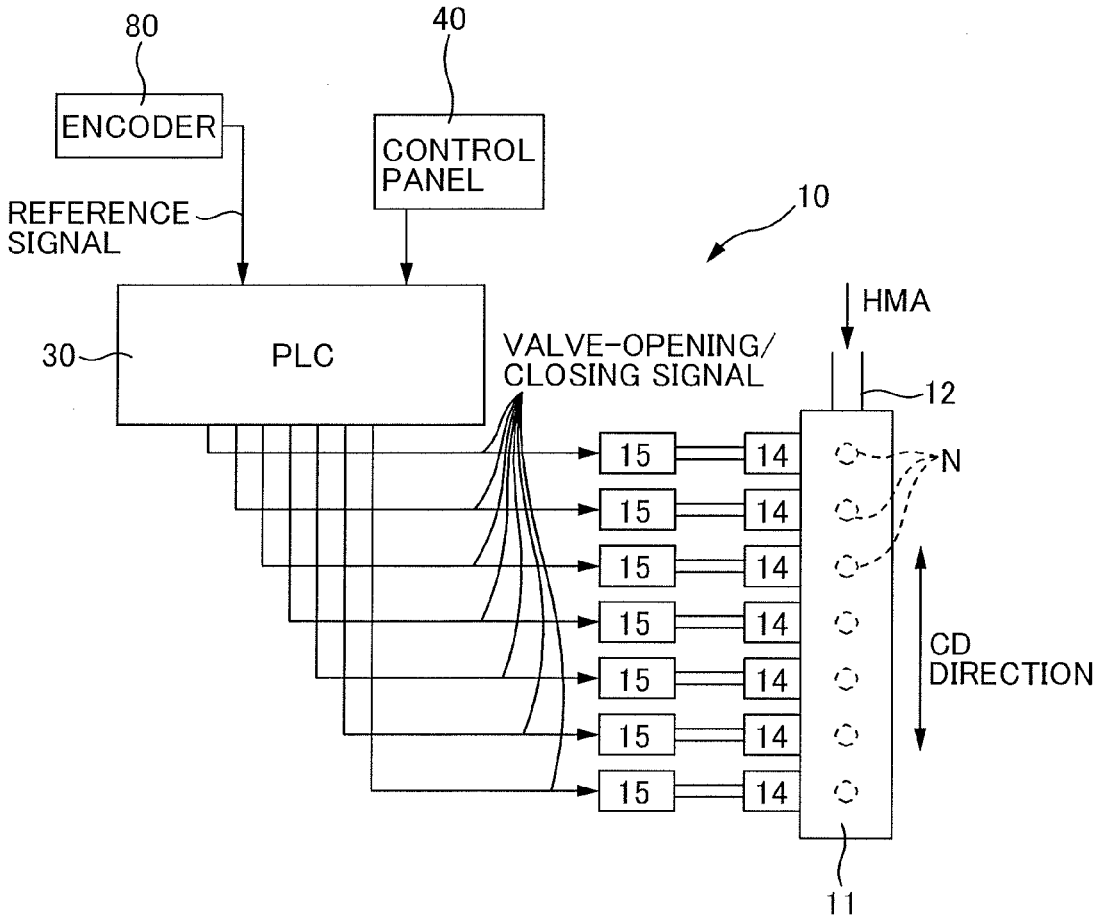
FIG. 2 is a schematic diagram of the configuration of HMA applying device 10.
Figure 3:
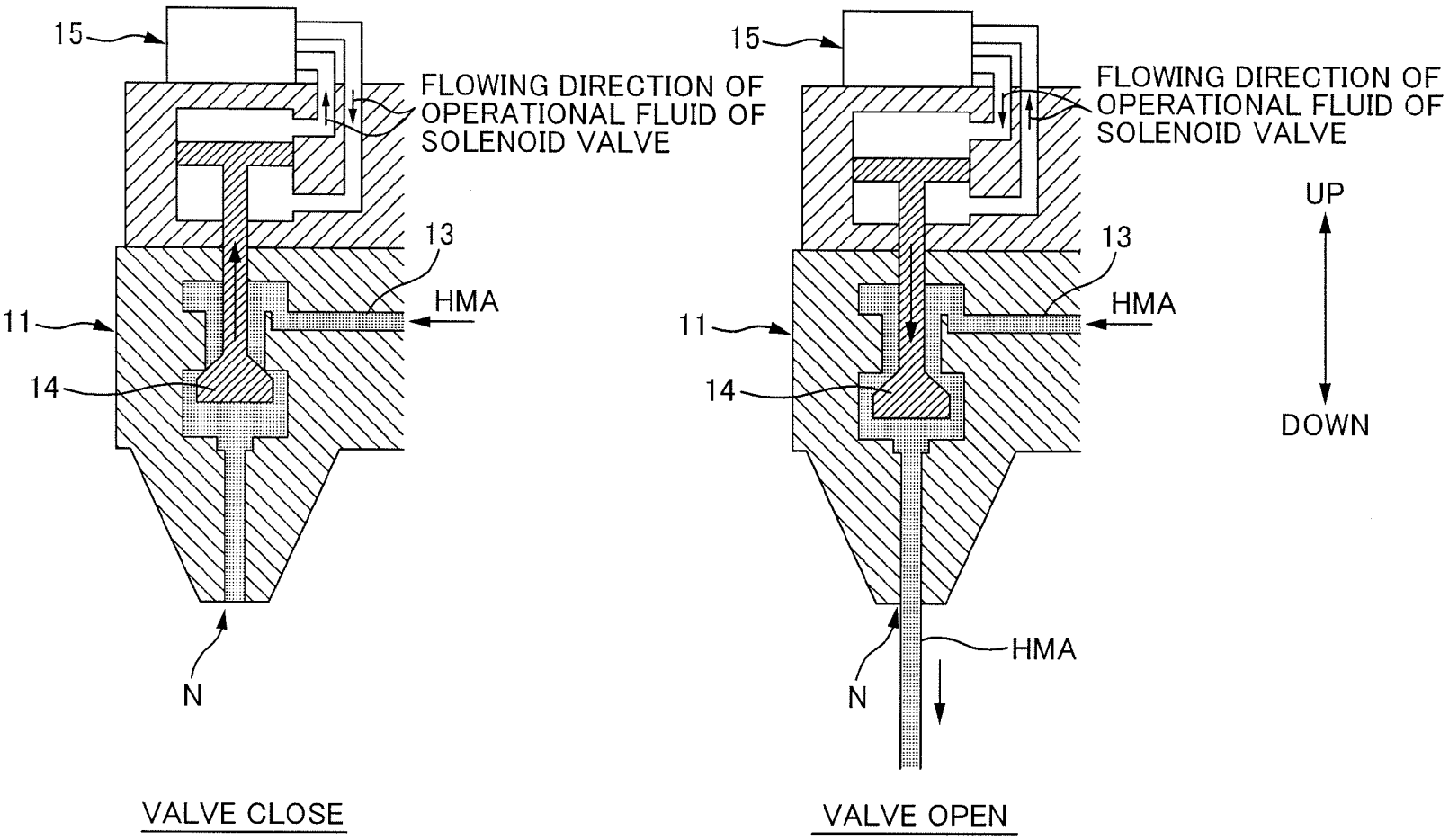
FIG. 3 is a longitudinal sectional view of a head 11 of the HMA applying device 10.

FIG. 2 is a schematic diagram of the configuration of the HMA applying device 10. This HMA applying device 10 includes a head 11, a PLC 30 (programmable logic controller) which serves as a controller, and a control panel 40. The head 11 has a plurality of (for example, 7) nozzles N (corresponding to the "discharge opening") lined up in the CD direction. Also, the head 11 is provided with one supply path 12 which supplies hot-melt adhesive to a flow path in the head 11. On the downstream side of the supply path 12, the flow path is divided into branches corresponding to the nozzles N; that is, one branch path 13 (FIG. 3) is formed for each nozzle N. As shown in the longitudinal sectional view of the head 11 in FIG. 3, each branch path 13 has a valve 14 which opens and closes the flow path corresponding to the branch path 13. Each valve 14 has a solenoid valve 15. To each solenoid valve 15, valve-opening/closing signal is sent from the PLC 30, and thereby, the solenoid valve 15 makes the corresponding valve 14 to open and close. The nozzles N intermittently discharge hot-melt adhesive towards the continuous sheet member 2. Therefore, as shown in FIG. 1B, band-like applying areas 9 along the MD direction are intermittently formed respectively for the nozzles N.

The PLC 30 sends a valve-opening/closing signal depending on the transportation amount of the continuous sheet member 2, at a timing which is determined for each of the valves. Therefore, the band-like applying areas 9, 9 . . . formed by the nozzles N are all combined, resulting in the application pattern in which two approximate sine curves are lined up in the CD direction, as shown in FIG. 1B.

The valve-opening/closing signals are set, for example, by the control panel 40. The control panel 40 includes input buttons corresponding to the valves 14 for inputting the first regulation values, the second regulation values and the like, the first regulation values instructing the opening timing and the second regulation values instructing the closing timing of the valves 14. When a digital value that is input from the encoder 80 reaches the first regulation value, the PLC 30 sends the valve-opening signal to the solenoid valve 15. Also, when the digital value reaches the second regulation value, the PLC sends the valve-closing signal to the solenoid valve 15. This makes the valves 14 to open and close.

Figure 4:
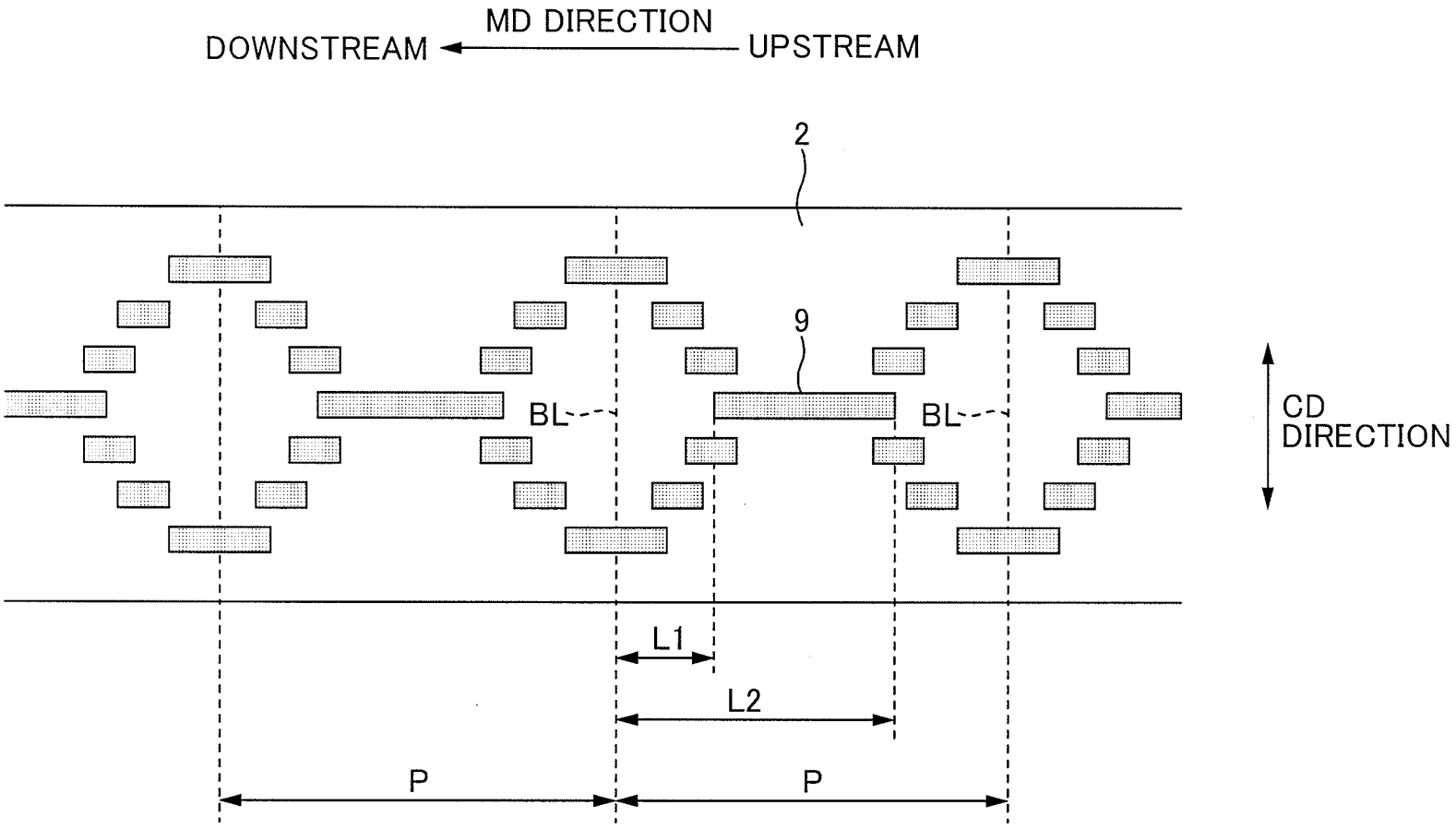
FIG. 4 is a plan view of a continuous sheet member 2, which is for describing input values of a first regulation value and a second regulation value.

Input values of the foregoing first regulation values, second regulation values, etc are basically determined based on the product specification of the diaper. FIG. 4 is an explanatory diagram thereof, which is a plan view of the continuous sheet member 2. The description of the HMA applying area 9 at the center in the CD direction in FIG. 4 will be made below. The following distances are predetermined typically based on the product specification of the diaper: a distance from the downstream end of an HMA applying area 9 to the boundary position BL upstream in the MD direction of the diapers; and a distance from the upstream end of the applying area 9 to the boundary position BL. These distances are respectively referred to as L1 and L2. Basically, the input value of the first regulation value is obtained by the following formula (1), and the input value of second regulation value is obtained by the following formula (2).

$$\text{Input Value of First Regulation Value}=L1/P\times 8192. \quad (1)$$

$$\text{Input Value of Second Regulation Value}=L2/P\times 8192. \quad (2)$$

It should be noted that "P" of the foregoing formulas 1 and 2 is the product pitch P in the MD direction, that is, the total length of a diaper in the MD direction. Also, "8192" of the foregoing formulas 1 and 2 is the number of the digital values (0 to 8191) which the encoder 80 output during a period in which the sheet member 2 is transported by an amount corresponding to the product pitch P.

However, the hot-melt adhesive discharged based on the foregoing input values can land at a target applying area of a diaper precisely if the following relationship is satisfied: the length of the conveying path of the continuous sheet member 2 between the pressing rolls 70 and the nozzles N of the head is an integral multiple of the product pitch P. This is because the digital value of the encoder 80, which are the reference signal, indicates which of the target positions in a diaper is currently processed at the position of the pressing rolls 70.

Further, even if the foregoing input values enable hot-melt adhesive to land at the target applying area precisely, it is possible that rearranging units in a periodic repair work of the manufacturing line or changing a product (diaper) causes change of the conveying path length of the continuous sheet member 2 between the pressing rolls 70 and the nozzles N of the head 11, and that the change causes a displacement of the actual applying area 9 from the target applying area in the MD direction under the condition of using the foregoing input values.

Therefore, each time when preparing the manufacturing line, an operator of the manufacturing line resets the foregoing regulation values. More specifically, the procedure is as follows. Firstly, while maintaining the foregoing regulation values at the same as the values from before the periodic repair work or the product change, hot-melt adhesive is discharged from the head 11 towards the continuous sheet member 2 which is being conveyed at a certain reference velocity Vb. Then, the operator measures the displacement 5 of the actual applying area 9 of the adhesive on the continuous sheet member 2 from the target applying area. The measured displacement δ is converted into digital value of the encoder 80 by the following formula 3, and such values as the foregoing first and second regulation values are shifted by the conversion value Y of the displacement and these shifted values are input to the first and second regulation values. Thereby, the open-close timing of the valves 14 is adjusted.

$$\text{Displacement Conversion Value } Y=5/P\times 8192 \quad (3)$$

However, the foregoing adjustment for all the valves 14, 14, . . . requires considerable time and effort. Further, if the cause is change of the conveying path length as mentioned above, the foregoing displacement conversion values Y of all the valves 14, 14, . . . should be approximately the same.

Figure 5A:
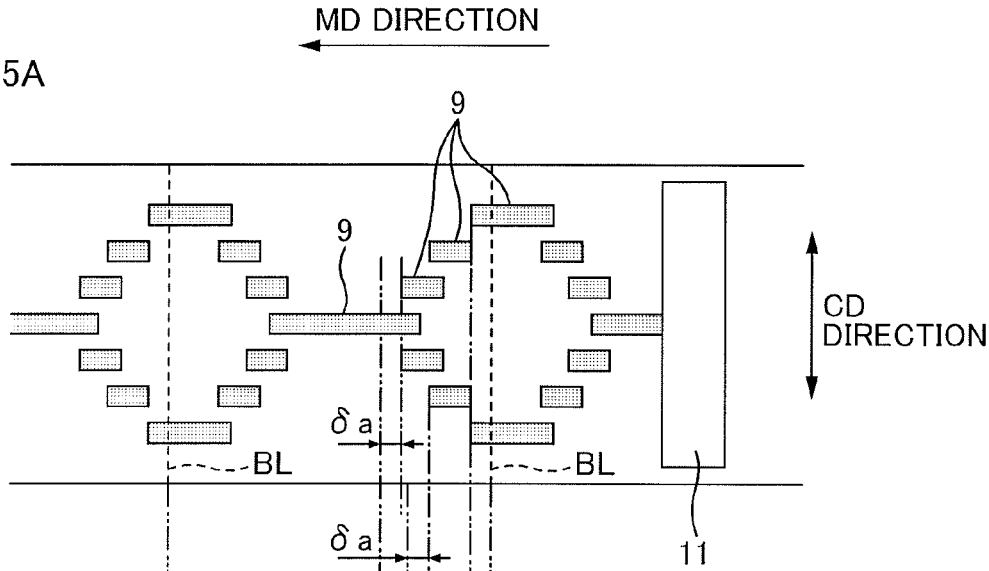
FIGS. 5A and 5B are diagrams showing how the application pattern of hot-melt adhesive is formed displaced in its entirety in the MD direction based on an adjustment value Ya.
Figure 5B:
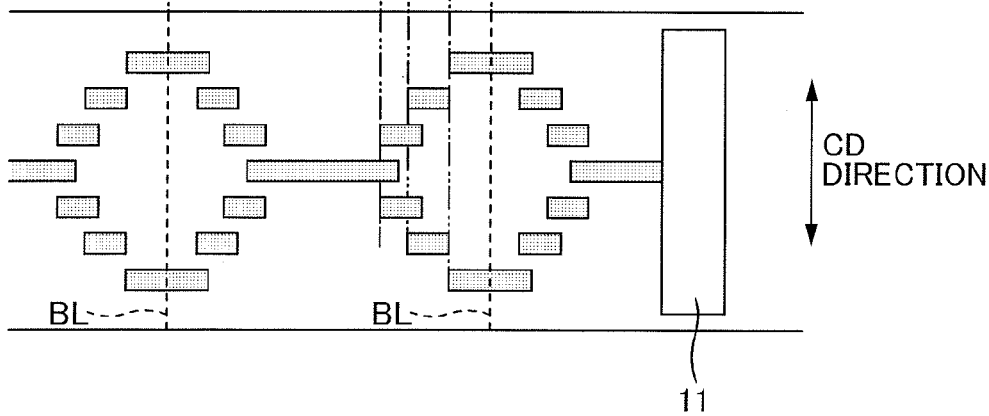

Therefore, in the first embodiment, only one of the displacement conversion values Y mentioned above is input as an adjustment value Ya (corresponding to the "shared adjustment value") from the control panel 40. Then, the PLC 30 executes an operation so that the first and second regulation values are shifted by the adjustment value Ya, these values being associated with all the valves 14, 14, . . . of the head 11. The shifted values, which are the operation results, are stored in a memory of the PLC 30 as a new first regulation value and a new second regulation value. Thereafter, the PLC 30 sends valve-opening/closing signals to the valves 14 based on such values as the new first regulation values and the new second regulation values which are reset respectively for the valves 14. Therefore, the application pattern of hot-melt adhesive is displaced by a length δa (=Ya/8192×P: corresponding to the adjustment value Ya) while substantially maintaining the shape of the pattern, from the state shown in FIG. 5A to the state shown in FIG. 5B.

In order to shift the open-close timing so that the application pattern is displaced downstream in the MD direction (that is, to advance the timing), an adjustment value Ya which is a negative value is added to the first and second regulation values. On the other hand, in order to shift the open-close timing so that the application pattern is displaced upstream (that is, to delay the timing), an adjustment value Ya which is a positive value is added. Whether the timing is advanced or delayed is determined by the displacement relationship in the MD direction between the target applying area and the actual applying area 9.

Further, in the foregoing example, the instruction values, such as the first regulation value, of the valve-opening/closing signal are shifted at the same time for all the valves 14, 14, . . . by the adjustment value Ya; thereby the new first regulation value, etc are determined. However, unlike the foregoing example, the digital value which is output by the encoder 80 may be shifted by the adjustment value Ya. In this case, the PLC 30 compares the first regulation value, the second regulation value, and the like with the digital value which is shifted by the adjustment value Ya. Based on the comparison, the PLC 30 outputs the valve-opening signal and/or the valve-closing signal. In order to shift the open-close timing so that the application pattern is displaced downstream in the MD direction (that is, to advance the timing), an adjustment value Ya which is a positive value is added to the digital value. On the other hand, in order to shift the open-close timing so that the application pattern is displaced upstream (that is, to delay the timing), an adjustment value Ya which is a negative value is added.

Second Embodiment

In addition to the first embodiment mentioned above, the second embodiment includes changing the discharging timing of the hot-melt adhesive (that is, the open-close timing of the valves 14) according to the transport velocity V2 of the continuous sheet member 2. The configuration except for this point is almost the same as the first embodiment, the same description will be omitted.

Figure 6:
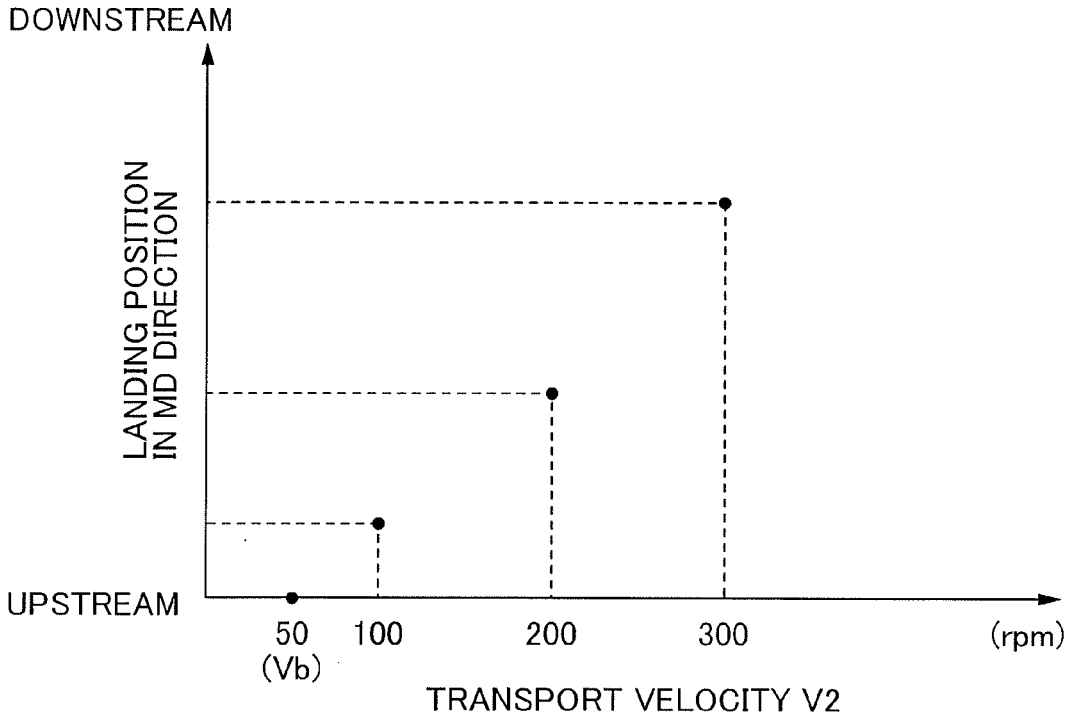
FIG. 6 is a graph showing a relationship between the transport velocity V2 of the continuous sheet member 2 and a position at which hot-melt adhesive discharged from the head 11 lands on the sheet member in the MD direction.

FIG. 6 is a graph showing a relationship between the transport velocity V2 of the continuous sheet member 2 and a position at which hot-melt adhesive discharged from the head 11 lands on the continuous sheet member 2. As can be seem from FIG. 6, the landing position is displaced more downstream in the MD direction, as the transport velocity V2 becomes greater. The reason is as follows: because the tips of the nozzles N are opposite the continuous sheet member 2 with a certain spacing, it always takes a certain period of time for hot-melt adhesive that is discharged from the tips of the nozzles N to land on the continuous sheet member 2; therefore, the continuous sheet member 2 moves greater during the certain time period as the transport velocity V2 becomes greater. Therefore, change of the transport velocity V2 of the continuous sheet member 2 causes variation of the HMA applying areas 9 in the MD direction.

Therefore, in the second embodiment, in order to suppress the variation of the applying areas 9, the transport velocity V2 is measured in real time. And then, based on the measured value of the transport velocity V2, the PLC 30 performs successively a compensation of the values of the foregoing new first and/or second regulation values. The PLC 30 compares the compensated new first regulation value and new second regulation value with the digital value of the encoder 80. Based on the comparison, the PLC 30 sends the valve-opening/closing signal to the valves 14. The foregoing compensation and comparison are repeatedly performed with a control period Tc of a few milliseconds. This enables the PLC to send the valve-opening/closing signal always at an appropriate timing, regardless of the transport velocity V2 which changes gradually. The measured value of the transport velocity V2 is sent instantly to the PLC 30 from a speedometer such as a pulse generator, etc (not shown), the speedometer being included in the vicinity of the pressing rolls 70 or the head 11.

Figure 7:
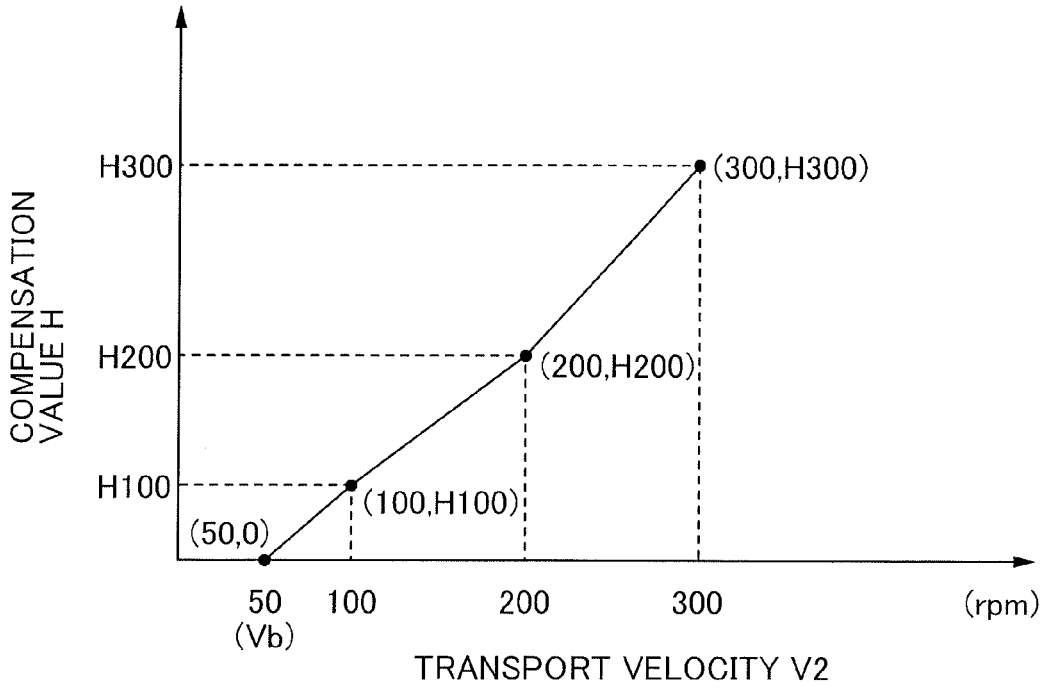
FIG. 7 is a graph showing a relationship between the transport velocity V2 and a compensation value H which is subject to a compensation according to the second embodiment.

FIG. 7 is a graph showing a relationship between the transport velocity V2 and a compensation value H which is subject to the foregoing compensation. In this example, the compensation value H is determined as follows: the slowest value of the transport velocity V2 in the manufacturing line is defined as the reference velocity Vb and the compensation value H associated with the reference velocity Vb is set to zero (a so-called reference value), for example. That is, assuming that a landing position at this reference velocity Vb is defined as a reference landing position, the compensation value H associated with various values of the transport velocity V2 are determined based on displacement 61 of the landing position from the reference landing position. Therefore, the foregoing compensation value H is calculated as follows. While actually transporting the continuous sheet member 2, for example, at a transport velocity V2 to which the corresponding compensation value H has to be obtained, hot-melt adhesive is discharged from the head 11. Then, the displacement 61 of its landing position from the reference landing position is measured, and the displacement δ1 in the following formula 4 is substituted.

$$\text{Compensation Value } H=61/P\times 8192 \quad (4)$$

Using the relationship shown in the graph of FIG. 7, the compensation of the foregoing new first and second regulation values is performed as follows.

Firstly, while successively receiving from the speedometer the transport velocity V2 which is measured in real time, the PLC 30 obtains the compensation value H corresponding to the received value of the transport velocity V2 based on the relationship of FIG. 7. The obtained compensation value H is subtracted from the foregoing new first and second regulation values. The values after the subtraction becomes the new first and second regulation values, and the first and second regulation values are updated.

It should be noted that, the relationship between the transport velocity V2 and the compensation value H shown in FIG. 7 is stored in the memory of the PLC 30 in a form of a compensation-value table consisting of a plurality of pairs of the transport velocity V2 and the corresponding compensation value H. For example, the compensation-value table can accommodate four data pairs of (V2, H): (50, 0), (100, H100), (200, H200), and (300, H300). A compensation value H corresponding to any value of the transport velocity V2 which is not stored in the compensation-value table is obtained by interpolation using two data pairs among the foregoing four pairs stored in the compensation-value table. For example, if the transport velocity V2 is between 200 (rpm) and 300 (rpm), the compensation value H corresponding to the velocity is obtained by linear interpolation based on the following formula 5.

$$H=(H300-H200)/(300-200)\times(V2-200)+H200 \quad (5)$$

The compensation-value table mentioned above is prepared for each of the valves 14. In addition, the table is prepared for each of the opening and closing operations of every valve 14. The reason the compensation-value table is prepared for each of the opening and closing operations is because the time it takes to open the valve 14 is sometimes different from the time it takes to close the valve 14.

In the second embodiment, the valves 14 of the nozzles N included in the head 11, a flow path from the valves 14 to the nozzles N, and the like are configured in the same manner over all the nozzles N, N . . . . In addition thereto, a distance between the continuous sheet member 2 and the tip of each nozzle N is set to the same over all the nozzles N, N . . . . Therefore, as for the operation of discharging hot-melt adhesive based on the valve-opening/closing signal, there is substantially no difference among the nozzles N, N, . . . of the head 11.

In this case, it is desirable that all the valves 14, 14, . . . share the same compensation-value table, not that each of the valves 14 has its own compensation-value table. That is, it is desirable that one compensation-value table for the opening operation and one compensation-value table for the closing operation are included and that this pair of the compensation-value tables are shared by all the valves 14, 14, . . . .

In this case, it is sufficient that, in some cases such as preparing the manufacturing line, an operator obtains the foregoing data of the compensation-value table, that is, the plurality of data pairs (V2, H) mentioned above, for just any one of the valves 14 in the head 11. This can make the workload it takes for the operator to obtain the data of the compensation-value table considerably smaller than when obtaining the data for every valve.

Further, when the PLC 30 repeats its operations such as compensation with a certain control period Tc as mentioned above, as for the compensation operation it is not necessary to obtain a large number of compensation values H referring to the large number of compensation-value tables. As a result, an operational load of the PLC 30 can be reduced considerably. The more detailed description is as follows. With this method, when the PLC 30 sends the valve-opening signals to the valves 14, the compensation value H corresponding to the transport velocity V2 from the speedometer is obtained based on one compensation-value table for the opening operation. And then, the compensation value H is defined as a shared compensation value H for all the valves 14, 14, . . . , and the compensation value H is subtracted from the new first regulation value of each valve 14. The compensation for the opening operation is completed. In the same way, when the PLC 30 sends the valve-closing signals to the valves 14, the compensation value H corresponding to the transport velocity V2 from the speedometer is obtained based on one compensation-value table for the closing operation. And then, the compensation value H is defined as a shared compensation value H for all the valves 14, 14, . . . , and the compensation value H is subtracted from the new second regulation value of each valve 14. The compensation for the closing operation is completed. This makes it possible to reduce the operational load of the PLC 30.

Third Embodiment

Figure 8:
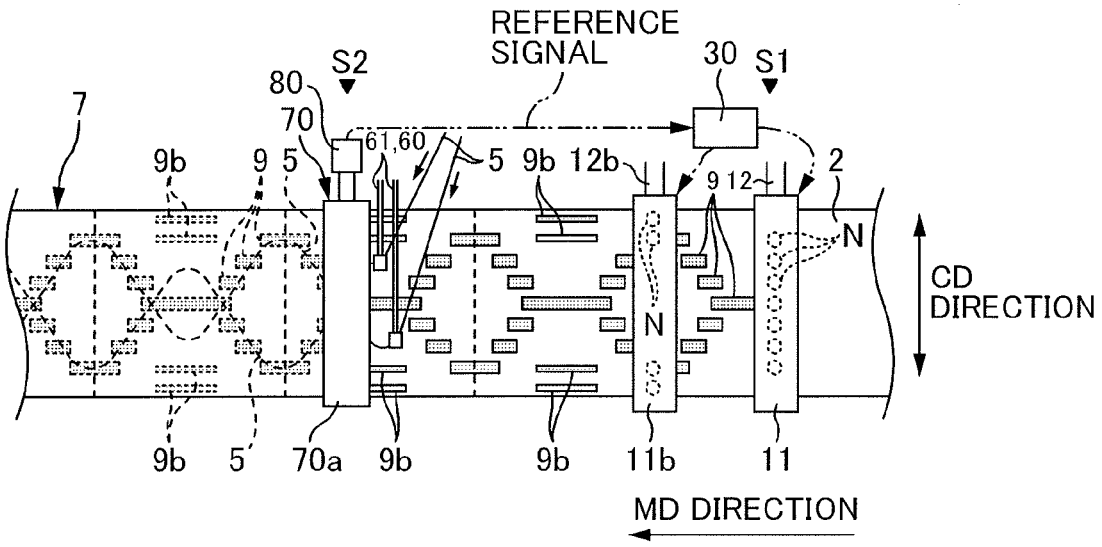
FIG. 8 is a plan view of an HMA applying device 10 according to the third embodiment.

FIG. 8 is a plan view of an HMA applying device 10 according to the third embodiment. In the foregoing first embodiment and second embodiment, the number of the head 11 of the HMA applying device 10 is one. However, in the third embodiment shown in FIG. 8, two heads 11 and 11*b*, as an example of a plurality of the heads 11, are arranged and their positions in the MD direction are different. In this example, using the control panel 40, the foregoing adjustment value Ya can be set up independently for each of the heads 11 and 11*b*.

That is, the PLC 30 can set up the first regulation value, the second regulation value, etc for each of the valves included in the heads 11 and 11*b*; in addition, the adjustment value Ya (corresponding to the "first shared adjustment value" and "second shared adjustment value") can be set up for each of the heads 11 and 11*b*. Therefore, the adjustments of these heads 11 and 11*b* will not affect each other. That is, the open-close timing of the valves 14, 14, . . . included in either one of the heads 11 and 11*b* can be shifted at the same time for all of the valves by an amount associated with the adjustment value Ya so that the application pattern is displaced in the MD direction.

In this example, one of the heads, the head 11, has the same function as the foregoing first and the second embodiment. In other words, the head 11 applies hot-melt adhesive that is for joining the continuous sheet member 2 and the rubber threads 5 and 5, the rubber threads 5 and 5 forming leg gathers. On the other hand, the other head, the head 11*b*, intermittently forms in the MD direction HMA applying areas 9*b*, 9*b* . . . which is for joining the continuous sheet member 2 and rubber threads (not shown), the rubber threads forming waist gathers, for example.

Further, in this example, the plurality of nozzles N, N . . . included in the head 11 correspond to the "first discharge opening group," and the plurality of valves 14 in the head 11 that are respectively associated with the nozzles N correspond to the "first valve group". On the other hand, the plurality of nozzles N, N . . . included in the head 11*b* correspond to the "second discharge opening group," and the plurality of valves 14, 14, . . . in the head 11*b* that are respectively associated with the nozzles N correspond to the "second valve group".

In addition to the foregoing adjustment values Ya for the heads 11 and 11*b*, the PLC 30 may have a shared adjustment value Yc (corresponding to the "third shared adjustment value") which is for shifting the open-close timing by the same amount at the same time for all of the valves 14, 14, . . . of these two heads 11 and 11*b* so that the application pattern is displaced in the MD direction. In this case, the discharging timing can be conveniently shifted by the same amount at the same time for all of the valves 14, 14, . . . of these two heads 11 and 11*b* so that the application pattern is displaced in the MD direction.

The configuration mentioned above can be achieved in the following manner, etc: the adjustment value Ya and the adjustment value Yc are added to the first regulation value and second regulation value of the foregoing first and second embodiments, the values after the addition are stored by the PLC 30 into the memory as a new first regulation value and a new second regulation value.

By the way, in the third embodiment, as mentioned above, the head 11 located upstream in the MD direction is provided as an example of a unit including the "first discharge opening group" and the "first valve group", and the head 11*b* located downstream is provided as an example of a unit including the "second discharge opening group" and the "second valve group". Also, the configuration in which the units each have their own adjustment value Ya is provided. However, the definition of the units is not limited thereto. For example, the unit may be defined based on the supply path 12 (FIG. 2) which is for supplying hot-melt adhesive to the flow path in the head 11. That is, for a different supply path 12, a different unit may be defined. In this case, it can be said that the controller 30 includes the foregoing adjustment values Ya for each supply path 12 respectively. This configuration has some advantages; for example, it makes it possible to effectively suppress deterioration of the accuracy of the position at which hot-melt adhesive lands on the sheet, which may be caused when the hot-melt adhesive is discharged through the different supply paths 12. The more detailed description is as follows.

As shown in FIG. 8, the heads 11 and 11*b* have a different supply path: supply paths 12 and 12*b*. Therefore, it is possible that, depending on any influence such as ambient temperature, the heads 11 and 11*b* are different in properties such as viscosity of the supplied hot-melt adhesive. In this case, between the nozzles N of the head 11 and the nozzles N of the head 11*b*, discharge characteristics such as the discharge speed of hot-melt adhesive and the like are different from each other. As a result, using the same adjustment value Ya for both of the heads 11 and 11*b* makes it difficult for hot-melt adhesives discharged from these heads to land at their own target positions. In other words, while the hot-melt adhesive discharged from either one of the heads 11 and 11*b* can land on its own target position using the adjustment value Ya, the hot-melt adhesive discharged from the other head 11*b* (11) cannot.

On this point, if the adjustment values Ya are prepared for each of the supply paths 12 and 12*b* as mentioned above, different adjustment values Ya can be set up between the supply paths 12 and 12*b*. Therefore, the landing positions can be adjusted individually for each of the heads 11 and 11*b* without affecting the adjustments of each other. This makes it possible to increase the accuracy of the landing positions, for both of the heads 11 and 11*b*. In this example, the supply path 12 of the head 11 corresponds to the "first supply path," and the supply path 12*b* of the head 11*b* corresponds to the "second supply path".

Other Embodiments

While the embodiments according to the invention are described above, the invention is not limited to the embodiments and the invention can be altered as described below.

In the first embodiment mentioned above, all the valves 14, 14, . . . included in one head 11 share the same adjustment value Ya. However, this invention is not limited thereto. For example, the configuration may be altered so that several of the valves 14, 14, . . . are selected from the control panel 40 and the adjustment value Ya is applied only to the selected valves 14, 14, . . . . In other words, the PLC 30 may be configured so that only the first regulation value, etc of the selected valves 14, 14, . . . are shifted by the adjustment value Ya.

In the desirable example of the second embodiment mentioned above, all the valves 14, 14, . . . included in one head 11 share the pair of the compensation-value tables for the opening and closing operations, and thereby all the valves 14, 14, . . . share the pair of shared compensation values for the opening and closing operations. However, this invention is not limited thereto. For example, the configuration may be altered so that several of the valves 14, 14, . . . are selected from the control panel 40 and only the selected valves 14, 14, . . . is compensated by using the pair of shared compensation values. In other words, the PLC 30 may be configured so that the first and second regulation values of the selected valves 14, 14, . . . are each compensated based on the shared compensation value for opening and the shared compensation value for closing respectively.

In the foregoing embodiments, the first and second regulation values are provided as examples. However, as a matter of course, as shown in FIG. 1B, if there is the valve 14 which forms two applying areas 9*f* and 9*f* along the MD direction in the product pitch P, a third regulation value for the valve-opening signal of that valve 14 is set up and also a fourth regulation value for the valve-closing signal is set up, in addition to the first and second regulation values. It should be noted that in the case of three or more applying areas 9, 9, 9 . . . in the MD direction, the number of the regulation values increases accordingly.

In the second embodiment mentioned above, the speedometer is included in order to measure the transport velocity V2 of the continuous sheet member 2. However, this invention is not limited thereto. For example, it is acceptable that the PLC 30 executes operations based on the following formula 6, thereby the transport velocity V2 is calculated based on the time interval ΔT at which the encoder 80 outputs the digital value. However, in this case, the operational load of the PLC 30 increases. Therefore, the speedometer is preferably included.

$$V2=\Delta D/\Delta T \tag{6}$$

The ΔD in the foregoing formula 6 means an increment ΔD of the transportation amount of the continuous sheet member 2 from the time of output of a certain digital value (e.g., 8190) to the time of output of the next digital value (e.g., 8191), and the ΔD is a known value which each encoder has.

In the foregoing embodiment, a diaper is described as an example of the absorbent article. However, this invention is not limited thereto as long as an article absorbs such exudates as urine, menstrual blood, etc. For example, a sanitary napkin may also be employed.

In the foregoing embodiment, as an example of the encoder 80, an encoder which outputs a digital value at each rotation through a certain angle is provided. However, this invention is not limited thereto. For example, an encoder which generates a pulse at each rotation through a certain angle and outputs a reset signal at each rotation through the corresponding angle to the product pitch P (e.g. one turn) may be employed. In this case, the PLC 30 counts the number of the pulse output from the encoder, and resets the count to zero each time when receiving a reset signal. Thereby, the encoder cooperates with the PLC 30 and functions in the same manner as the foregoing encoder 80.

In the foregoing embodiment, the hot-melt adhesive is provided as an example of "fluid". However, the invention is not limited thereto as long as the fluid is a fluid such as a liquid or a gel having a sufficient flowability to be intermittently discharged towards the continuous sheet member 2 associated with an absorbent article. Another type of adhesive may be employed, and any fluid other than adhesive may also be employed.

In the foregoing embodiment, the non-contact discharge opening in which the tip of nozzle N, serving as a discharge opening, is not in contact with the continuous sheet member 2 is described. That is, the tip of the nozzle N is positioned with a spacing between the continuous sheet member 2. However, the invention is not limited thereto. A contact discharge opening may be employed. In other words, the tip of the nozzle N or a member disposed on the tip may be in contact with the continuous sheet member 2. As an example of the contact discharge opening, the following configuration can be provided: the tip of the nozzle N is provided with a sphere which can rotate like a ball of a ballpoint pen, the sphere is moved by keeping in contact with the continuous sheet member 2. In the case of this contact discharge opening, hot-melt adhesive does not fly through a space between the tip of the nozzle N and the continuous sheet member 2 when being discharged. Therefore, without the foregoing compensation of the transport velocity V2 according to the second embodiment, the accuracy of the landing position of the adhesive can be achieved in some degree.

In the third embodiment mentioned above, the configuration including two heads 11 and 11*b* are provided as an example of a plurality of the heads 11. However, the number of the heads is not limited to two. Another head may be placed at a different position in the MD direction in the manufacturing line. As a matter of course, in this case, each head may have its own adjustment value Ya in the same manner as the third embodiment. Depending on the case, the adjustment value Ya may be shared by all of the heads 11, 11*b*, . . . . With such a configuration, by inputting a single adjustment value Ya, the discharging timing can be shifted by the same amount at the same time for all the valves 14, 14, . . . included in all the heads 11, 11*b*, . . . so that the application pattern is displaced in the MD direction.

In the foregoing embodiment, the nozzles N correspond to the valves 14 respectively. However, this invention is not limited thereto. For example, a plurality of nozzles N may correspond to one of the valves.

REFERENCE SIGNS LIST

2 continuous sheet member for top sheet (continuous sheet member),
3 continuous sheet member for back sheet,
5 rubber thread,
7 continuous body of half-completed product,
9 applying area, 9*b* applying area, 9*f* applying area,
10 HMA applying device (fluid discharging device),
11 head, 11*b* head,
12 supply path (first supply path), 12*b* supply path (second supply path),
13 branch path,
14 valve,
15 solenoid valve,
30 PLC (controller),
40 control panel,
60 rubber-thread supply device,
61 arm,
70 pressing roller, 70*a* roll, 70*b* roll,
80 rotary encoder,
N nozzle (discharge opening),
BL boundary position,
S1 HMA application section, S2 processing section

The invention claimed is:

1. A fluid discharging device configured to discharge fluid from a plurality of nozzles towards a continuous sheet member which is continuously transported in a transporting direction, the nozzles being arranged in a width direction of the continuous sheet member for an absorbent article, said fluid discharging device comprising:

a head having the plurality of nozzles and a plurality of valves corresponding to the plurality of nozzles, said plurality of valves being configured to intermittently discharge the fluid in a predetermined pattern on the continuous sheet member from the plurality of nozzles by opening and closing operations;

a controller coupled to the head;

a control panel coupled to the controller; and an encoder coupled to the controller, wherein the head has a supply path and a flow path downstream of the supply path, the head is configured to receive the fluid from the supply path, the flow path is divided into branch paths corresponding to the respective nozzles and the respective valves, the control panel is configured to input a displacement conversion value Ya for all of the plurality of valves, the controller is configured to set, for each of the valves, a first regulation value setting up an opening timing of said valve, and a second regulation value setting up a closing timing of said valve, the first and second regulation values corresponding to a value indicating a transportation amount of the continuous sheet member, control the opening and closing operations of each of the valves individually depending on the transportation amount of the continuous sheet member, and calculate a shared adjustment value based on the displacement conversion value Ya inputted through the control panel amount, the shared adjustment value corresponding to the value indicating the transportation amount, and the shared adjustment value being shared by all of the plurality of valves, and shift the first regulation value and the second regulation value for all of the plurality of valves by the shared adjustment value, wherein the controller is configured to cause the predetermined pattern of the discharged fluid to be displaced by a length δa while maintaining a shape of the predetermined pattern, the length δa being defined by a formula $\delta a = Ya/Nd$, where Nd is a number of digital values which the encoder is configured to output during a period in which the continuous sheet member is transported by an amount corresponding to a product pitch.

2. The fluid discharging device according to claim 1, wherein the controller is configured to calculate a shared compensation value of the opening and closing operations of all of the valves based on a transport velocity of the continuous sheet member, and the controller is configured to shift the first regulation value and the second regulation value for all of the plurality of valves by the shared adjustment value and the shared compensation value.

3. The fluid discharging device according to claim 1, wherein said plurality of valves defines a first valve group, the nozzles corresponding to the valves that belong to the first valve group define a first nozzle group, the shared adjustment value defines a first shared adjustment value, the fluid discharging device further comprises:

a second valve group including a plurality of valves, a second nozzle group including nozzles corresponding to the plurality of valves that belong to the second valve group, the second nozzle group being located on a downstream side of the first nozzle group in the transporting direction, and the controller is configured to shift an opening timing and a closing timing of all of the plurality of valves in the second valve group by a second shared adjustment value.

4. The fluid discharging device according to claim 3, wherein the controller is configured to calculate a third shared adjustment value, and the controller is configured to shift the opening timing and the closing timing of the valves that belong to the first valve group and the second valve group based on the third shared adjustment value, independently of the first shared adjustment value and the second shared adjustment value.

5. The fluid discharging device according to claim 1, wherein said plurality of valves defines a first valve group, the nozzles corresponding to the valves that belong to the first valve group define a first nozzle group, the shared adjustment value defines a first shared adjustment value, each of the valves of the first valve group is configured to receive the fluid from the supply path which defines a shared first supply path, the fluid discharging device further comprises:

a second valve group including a plurality of valves each configured to receive the fluid from a second supply path, a second nozzle group including nozzles corresponding to the valves that belong to the second valve group, and the controller is configured to shift an opening timing and a closing timing of all of the plurality of valves in the second valve group by a second shared adjustment value.

6. The fluid discharging device according to claim 1, wherein when the shared adjustment value is a negative value, the controller is configured to add the negative value to the first and second regulation values to advance the corresponding opening and closing timings for all of the valves, and when the shared adjustment value is a positive value, the controller is configured to add the positive value to the first and second regulation values to delay the corresponding opening and closing timings for all of the valves.

7. The fluid discharging device according to claim 2, wherein the controller is configured to subtract the shared adjustment value from the first and second regulation values to obtain new first and second regulation values for shifting the corresponding opening and closing timings for all of the valves.

8. The fluid discharging device according to claim 2, wherein the controller is configured to set a landing position of the fluid on the continuous sheet member at a reference transport velocity of the continuous sheet member as a reference landing position, and determine the shared adjustment value associated with various values of the transportation amount of the continuous sheet member based on a displacement of another landing position from the reference landing position.

* * * * *